United States Patent [19]

Henkin et al.

[11] Patent Number: 4,813,086

[45] Date of Patent: Mar. 21, 1989

[54] HYDROTHERAPY MASSAGE METHOD AND APPARATUS

[76] Inventors: Melvyn L. Henkin, 5011 Donna Ave., Tarzana, Calif. 91356; Jordan M. Laby, 3038 Bayshore, Ventura, Calif. 93001

[21] Appl. No.: 138,514

[22] Filed: Dec. 23, 1987

Related U.S. Application Data

[63] Continuation-in-part of Ser. No. 72,409, Jul. 13, 1987, abandoned, which is a continuation-in-part of Ser. No. 843,151, Mar. 24, 1986, Pat. No. 4,679,258.

[51] Int. Cl.[4] ..... A61H 33/02

[52] U.S. Cl. ..... 4/542; 4/492; 4/541; 4/544

[58] Field of Search ..... 4/542, 544, 541, 491, 4/492, 543; 128/66; 239/416.4, 428.5, 416, 587, 429, 416.5, 413

[56] References Cited

U.S. PATENT DOCUMENTS

| | | | |
|---|---|---|---|
| 4,220,145 | 9/1980 | Stamp et al. | 4/542 |
| 4,335,854 | 6/1982 | Reynoso | 4/542 X |
| 4,339,833 | 7/1982 | Mandell | 4/542 |
| 4,466,141 | 8/1984 | Starkey | 4/488 |
| 4,520,514 | 6/1985 | Johnson | 4/542 X |
| 4,523,340 | 6/1985 | Watkins | 4/542 |
| 4,710,990 | 12/1987 | Morsey | 4/542 |
| 4,716,604 | 1/1988 | Watkins | 4/542 |

*Primary Examiner*—Henry K. Artis

*Attorney, Agent, or Firm*—Freilich, Hornbaker, Rosen & Fernandez

[57] ABSTRACT

Hydrotherapy apparatus including a rigid elongated conduit having a supply orifice and a discharge orifice. The conduit is mounted for swivel movement to enable the discharge orifice to traverse a path characterized by a series of small circular or semicircular path segments linked by translational path segments. The conduit is moved along said path by reaction forces produced by the discharged stream.

33 Claims, 8 Drawing Sheets

HYDROTHERAPY MASSAGE METHOD AND APPARATUS

RELATED APPLICATIONS

This is a continuation-in-part of application Ser. No. 072,409, filed July 13, 1987, now abandoned, which was a continuation-in-part of the application Ser. No. 843,151 issuing as U.S. Pat. No. 4,679,258 on July 14, 1987, whose disclosures are by reference incorporated herein. Related subject matter is disclosed in applicants, U.S. Pat. Nos. 4,692,950; 4,689,839; 4,715,071; and application Ser. No. 064,138 filed June 19, 1987.

BACKGROUND OF THE INVENTION

This invention relates generally to hydrotherapy and more particularly to an improved method and apparatus useful in spas, hot tubs, bathtubs, and the like for discharging a fluid (e.g. water-air) stream to impact against and massage a user's body.

Applicants' grandparent application Ser. No. 843,151 filed Mar. 24, 1986, now U.S. Pat. No. 4,679,258, discloses a method and apparatus for discharging a fluid stream, while concurrently translating the stream along a substantially random path. A user is thus able to fixedly position his body proximate to the apparatus to enable the discharged stream to impact against and sweep over an area of the user's body. In a typical application, the apparatus is mounted in an opening in the peripheral wall (i.e. including floor) of a spa, hot tub, bathtub, etc., generically referred to as a water tub. The apparatus includes a housing which can be formed integral with the tub wall but which more typically comprises a separate box-like structure adapted to be mounted adjacent to the rear face of the wall and accessible through the wall opening.

A preferred embodiment of said U.S. Pat. No. 4,679,258 is characterized by the use of a water-air jet assembly including a nozzle for discharging a water jet under pressure into a mixing cavity. The water jet creates a suction, via venturi action, which draws air into the cavity and the resulting water-air stream is then discharged into an elongated rigid conduit having a tubular supply section, a tubular discharge section, and a tubular intermediate section coupling said supply section to said discharge section. The conduit is open at both ends having a supply orifice at its supply section end and a discharge orifice at its discharge section end. The conduit is shaped such that the intermediate section axis deviates by an acute angle from the supply section axis. The axes of the supply and intermediate sections define a plane and the axis of the discharge section deviates by an acute angle from that plane. The supply bore defining said supply orifice. The ball is accommodated for swivel movement within a socket with the supply orifice open to the aforementioned mixing cavity. The conduit discharge end is left free to move within the tub wall opening across a substantially planar area roughly approximating an extension of the tub wall. The water-air stream is discharged from the discharge orifice in a direction having a primary massage component extending substantially perpendicular to the planar area and having a secondary thrust component extending substantially parallel to the planar area. The thrust component produces a lateral force for moving the discharge end along a path coincident with said planar area. The boundary of the planar area is substantially defined by a thrust modifier means in the form of a frame, which cooperates with a pivot pin secured to said conduit. The frame includes a series of open recesses, each intended to momentarily capture the pivot pin, as the conduit discharge end moves toward the area boundary. With the pivot pin so captured, the stream thrust component acts to rotate the discharge end around the pivot pin and thereby redirect the thrust component enabling the pivot pin to withdraw from its open recess and initiate a new traverse across the frame. Thus, the discharge orifice will traverse a path comprised of small substantially semicircular path segments, each described when the pivot pin is engaged in a recess, linked by longer translational path segments extending between recesses. The translational recess-to-recess path segments extend substantially across the frame and occur in an essentially random unpredictable pattern.

Applicants' parent application 072,409 discloses that in the aforedescribed embodiment of said U.S. Pat. No. 4,679,258, in the event the air inlet to the mixing cavity becomes obstructed (either intentionally or inadvertently), the suction created in the cavity can act to increase the drag, i.e. friction loss, between the conduit and its mounting means. As a result, the movement of the conduit discharge orifice may become sluggish.

Applicants' U.S. Pat. No. 4,715,071 discloses a hydrotherapy apparatus in which a passageway is provided around the swivel mounting of the conduit supply end for passing water from outside the conduit into the mixing cavity of the apparatus. As discussed therein, this action mitigates the effect of the suction force produced in the mixing cavity acting on the conduit itself.

SUMMARY OF THE INVENTION

The present invention is directed to alternative embodiments of the invention disclosed in said U.S. Pat. No. 4,679,258 structurally configured to provide improved massage performance.

In accordance with a first aspect of the invention, the conduit is specially configured to enable the discharge stream to produce a larger force for initiating and maintaining translational movement of the conduit discharge end.

In accordance with a further aspect of the invention, the swivel mounting for the conduit supply end is configured to define a passageway for permitting tub pool water to be drawn into the mixing cavity for the purpose of reducing friction loss in the swivel mounting and increasing the mass of the discharged stream.

In accordance with an additional aspect of the invention, the aforementioned open recesses for capturing the pivot pin are symmetrically arranged, preferably in a circular pattern, for influencing the conduit discharge orifice to traverse a more predictable path.

In accordance with a still further aspect of the invention, the thrust modifier means is specially configured to influence the conduit discharge orifice to traverse a path comprised of successive small substantially circular path segments linked by short translational path segments. More specifically, in a preferred embodiment of the invention, the open recesses of the thrust modifier frame are partially closed to allow the conduit pivot pin to escape only when the conduit is in a particular orientation. From this particular orientation, the forces produced by the stream discharged from the discharge orifice will normally move the pivot pin into an adjacent or near recess.

An improved embodiment of this application derives from the recognition that a user could place his body tightly against the thrust modifier frame and thus impede the stream exiting from the discharge orifice and thereby diminish discharge orifice movement. Accordingly, a preferred thrust modifier frame is provided in accordance with the present invention having radially extending openings to permit the discharge stream to readily flow from the discharge orifice without building up significant back-pressure in the conduit even when a user presses his body tightly against the thrust modifier frame.

DETAILED DESCRIPTION

Figure 1:
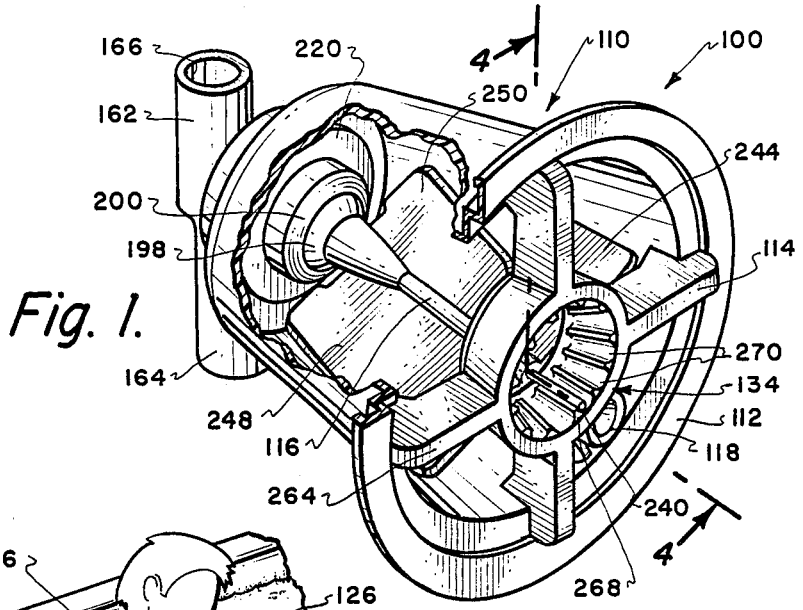
FIG. 1 is an isometric, partially broken away, view of a hydrotherapy apparatus in accordance with a first embodiment of the present invention.
Figure 2:
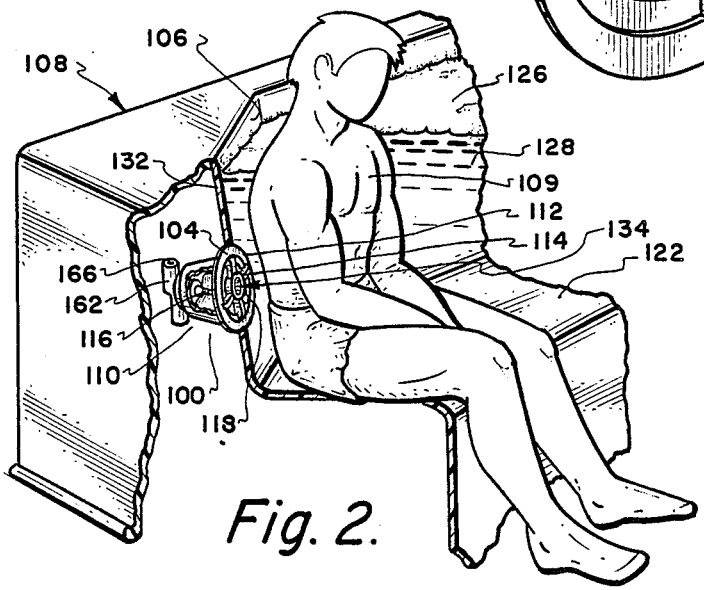
FIG. 2 is an isometric view, partially broken away, depicting the apparatus of FIG. 1 mounted behind the perimeter wall of a water tub.

Attention is initially directed to FIG. 1 which illustrates an isometric view of a hydrotherapy apparatus 100 in accordance with the present invention. The apparatus 100 is intended to be mounted in an opening 104 of the peripheral wall 106 of a water tub 108 such as a spa, hot tub, or bath tub, as depicted in FIG. 2, for massaging the body of a user 109. Briefly, the apparatus 100 is comprised of a tapered substantially cylindrical housing 110 having an open front frame 112 adapted to accommodate a front grill 114. A conduit 116 having a discharge orifice 118 is mounted for swivel movement in the housing 110 so as to enable the discharge orifice 118 to traverse a path defining an essentially planar travel area oriented substantially parallel to the grill 114. The conduit will be caused to swivel by reaction forces produced by a water stream discharged from the orifice 118.

FIG. 2 depicts the hydrotherapy apparatus 100 in use in a typical spa installation wherein the water tub 108 is shaped to define, for example, a bench 122 upon which a user 109 can comfortably sit with the major portion of his body below the upper surface 126 of a water pool 128. The water tub peripheral wall 106 preferably has one or more flat portions 132 through which the wall opening 104 is formed. The apparatus 100 is intended to be mounted in the opening 104 with the housing 110 projecting rearwardly from the flat wall portion 132 and with the housing frame 112 sealed against the front surface of the flat wall portion 132.

The general function of the apparatus 100 is to provide a pleasing massaging effect on the body of the user 109 without requiring that the user move his body relative to a fixedly positioned jet, as is customary in conventional spa installations. In order to achieve this effect, the conduit 116 is mounted so as to discharge a water stream from said discharge orifice 118 while concurrently moving the orifice along said path defining said planar travel area. The moving discharge stream thus sweeps across and impacts against a two dimensional area of the users body. In accordance with a first embodiment of the invention (FIGS. 4 and 11), the discharge orifice 118 describes a path comprised of successive substantially semicircular path segments linked by translational path segments. In accordance with second (FIGS. 12–15) and third (FIGS. 16–18) embodiments of the invention, the discharge orifice path is comprised of successive substantially circular path segments linked by short translational path segments. FIGS. 5–10 which primarily illustrate structural details of the conduit subassembly, are common to all three embodiments. As will be seen hereinafter, the first, second, and third embodiments differ only in the structural configuration of the front grill 114 and more particularly the thrust modifier frame (134 in FIG. 1) portion thereof.

Although the particular dimensions of apparatus 100 may vary considerably, in a typical embodiment it is contemplated that the housing 110 fit within a six inch diameter wall opening 104 and that the discharge orifice traverse a path defining a planar travel area having a diameter of about five inches with the path being comprised of circular (or semicircular) path segments of about two inch diameter Attention is now directed to FIGS. 4–11 which illustrate the structural details of a first embodiment of the present invention. Specifically, attention is initially directed to FIG. 4 which shows the housing 110 mounted within opening 104 of wall 106. The housing 110 is comprised of a wall 140 defining a tapered cylindrical portion 142. The front end of wall 140 terminates in the outwardly extending open frame 112 comprised of section 146 and 148 connected by shoulder 150. Shoulder 150 is intended to engage the edge of the tub peripheral wall 106 in the opening 104. Frame section 148 is intended to seal against the front surface of peripheral wall 106.

The cylindrical wall 140 blends into radially extending rear wall 156 which extends to wall 158 defining a short axially extending pipe section. The housing wall further defines a water supply pipe 162 and an air supply pipe 164. The water supply pipe 162 has an open end 166 intended to be connected to a source of pressurized water, such as electrically powered pump 168 of FIG. 3. The inner end of pipe 162 communicates with a nozzle insert 170 mounted to discharge a water jet along the axis of the aforementioned pipe section 158. The open end 172 of air pipe 164 can be left open to the ambient air or can be connected to the discharge side of an optional electrically powered blower 174, depicted in FIG. 3.

The apparatus 100 includes a conduit subassembly 180 (FIGS. 7–9) intended to be mounted in the housing 110. The conduit subassembly 180 is comprised of an elongated rigid conduit 116 shaped to essentially define a tubular supply section 186 having a supply orifice 188, a tubular discharge section 190 having said discharge orifice 118 and a tubular intermediate section 194 coupling said supply section to said discharge section. The outer wall surface 198 of the supply section 186 is spherically shaped to essentially define a ball 199 intended to be mounted for swivel movement within a socket member 200.

The socket member 200 comprises an essentially cylindrical member having a radially extending flange 202 which is mounted against the inner surface of the housing rear wall portion 156. The socket member 200 includes a cylindrical wall portion 210 which extends rearwardly from the flange 202 and is located substantially axially in the pipe section 158. An O-ring 212 is mounted on the exterior surface of the wall portion 210 for sealing against the interior surface of the pipe section 158. The socket member 200 has a radially inwardly extending lip 218 at its forward end surrounding an opening 220. An O-ring 224 is mounted on the interior surface of the lip 218 around the opening 220 and is intended to engage the outer spherical surface 198 of said supply section ball 199.

A ring 228 (FIG. 10) is mounted at the rear end of cylindrical wall 210 and internally accommodates an O-ring 230. The spaced O-rings 224 and 230, together with wall portion 210, define a socket 232 within which said conduit ball 199 can swivel. The ball and socket mounting defines an essentially universal joint enabling the ball 199 to rotate around the axis defined by nozzle 170 and also around first and second (e.g. vertical and horizontal) axes perpendicular to the nozzle axis.

FIGS. 4 and 7–9 illustrate a preferred conduit geometry in which the axis of the tubular intermediate section 194 deviates by an acute angle, e.g. 240°, from the axis of the tubular supply section 186 and the axis of the discharge section 190 deviates by an acute angle, e.g. 24°, from the plane defined by the axes of the supply and intermediate sections. The sections are preferably curved so as to blend smoothly into one another. Moreover, in order to develop maximum translational thrust on the discharge end of the conduit 116 the axis of the intermediate section 194 extends along a line displaced from the center of rotation of ball 199 within socket 232. As will be seen, the center of rotation can move axially through a limited distance but will always lie along the axis of nozzle 170. This displacement between the intermediate section axis and the center of rotation produces an enhanced turning moment for translating the discharge end of conduit 116.

Figure 8:
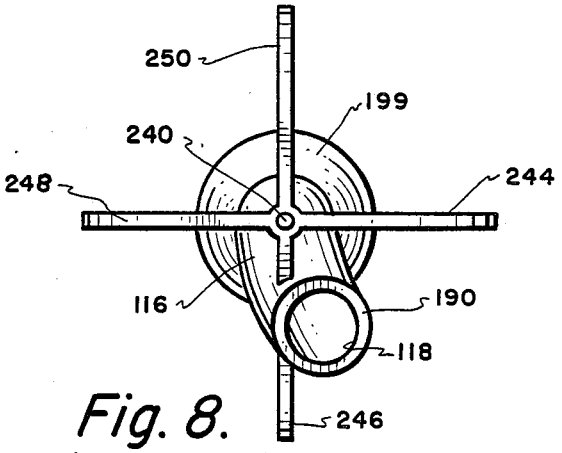
FIG. 8 is a front view of the conduit subassembly of FIG. 7.
Figure 9:
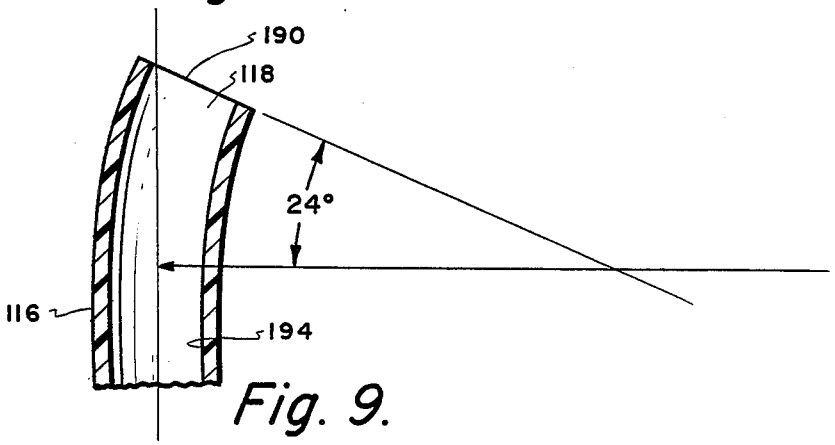
FIG. 9 is a sectional view taken substantially along the plane 9—9 of FIG. 7.
Figure 10:
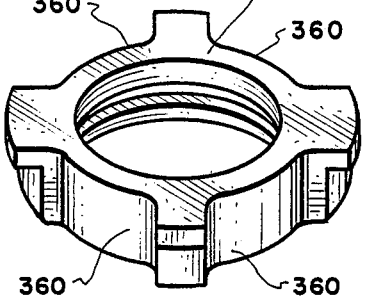
FIG. 10 is an isometric view of the mounting means rear ring shown in FIGS. 4 and 6.

The conduit subassembly 180 includes a forwardly projection pivot pin 240 which is mounted substantially along a projection of the conduit supply section 186 axis. A plurality of drag plates 244, 246, 248, and 250 extend outwardly from the conduit 116 in cruciform fashion with respect to pin 240 as is best depicted in FIG. 8.

Figures 4, 5, 6:
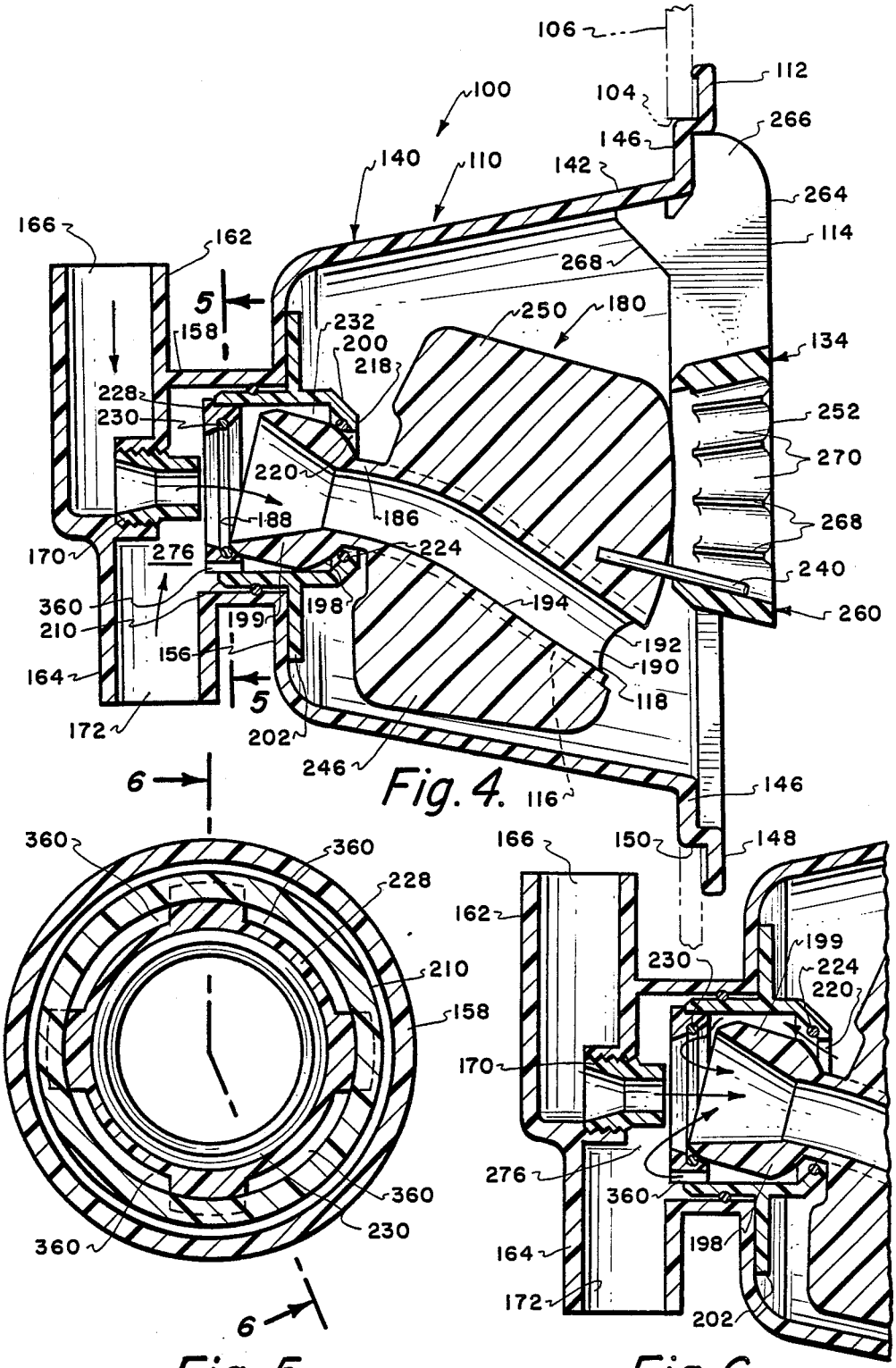
FIG. 4 is a sectional view taken substantially along the plane 4—4 of FIG. 1.
FIG. 5 is a sectional view taken substantially along the plane 5—5 of FIG. 4.
FIG. 6 is a sectional view taken substantially along the plane 6—6 of FIG. 5.
Figure 7:
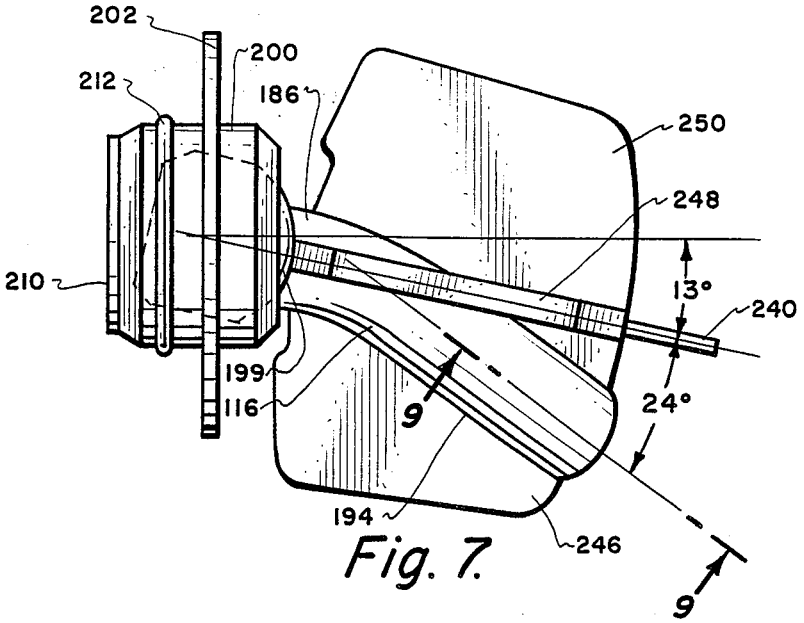
FIG. 7 is a side elevational view of a preferred conduit subassembly and mounting means in accordance with the present invention.
Figure 11:
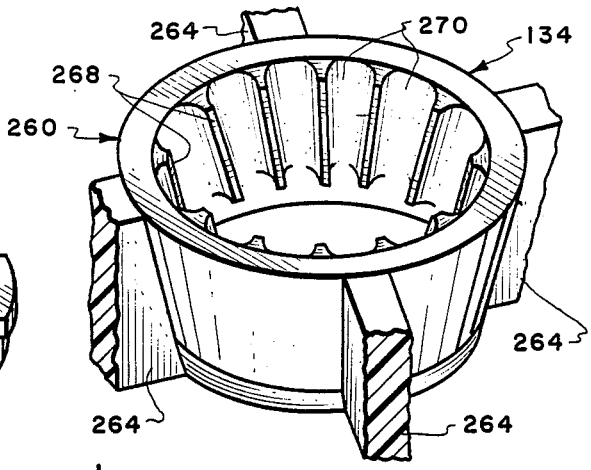
FIG. 11 is an isometric view, partially broken away, of the thrust modifier frame depicted in FIGS. 1 and 4.
Figure 12:
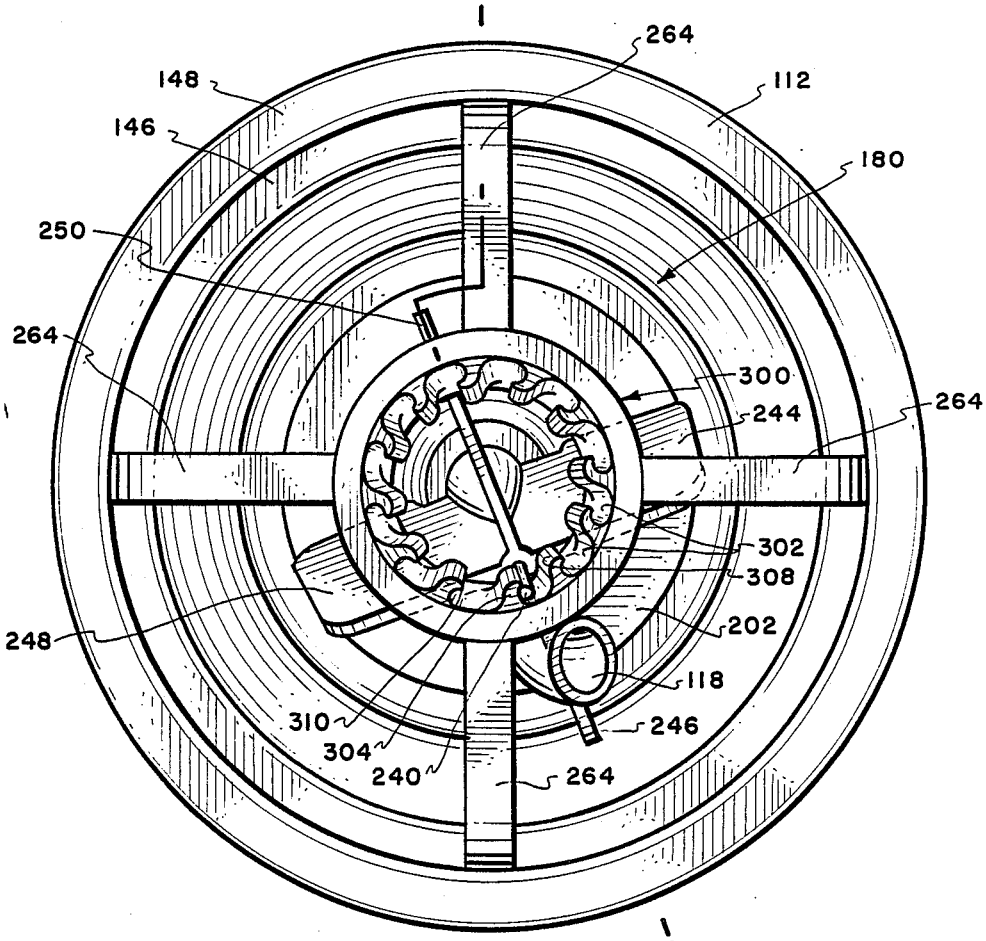
FIG. 12 is a front plan view of a front grill incorporating an alternative thrust modifier frame in accordance with a second embodiment of the invention.
Figure 13:
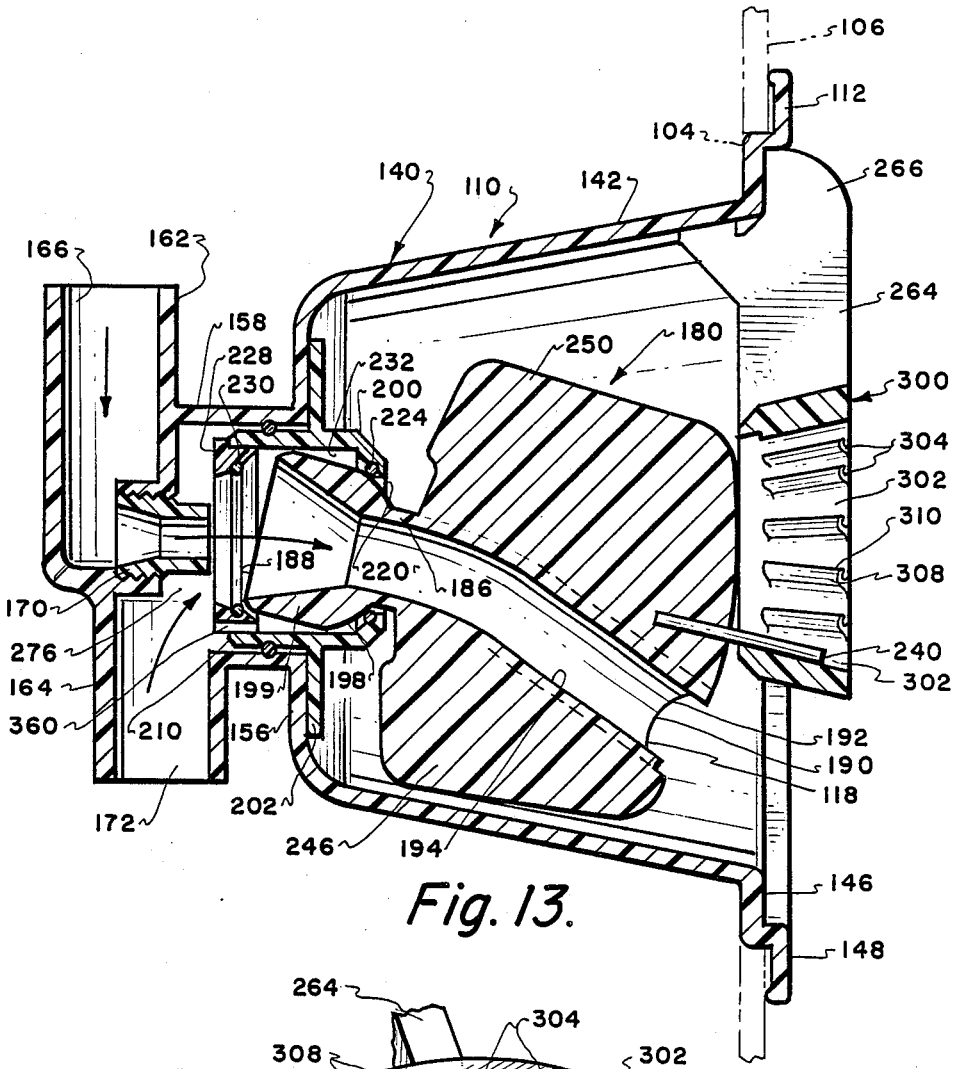
FIG. 13 is a sectional view taken substantially along the plane 13—13 of FIG. 12.
Figure 14:
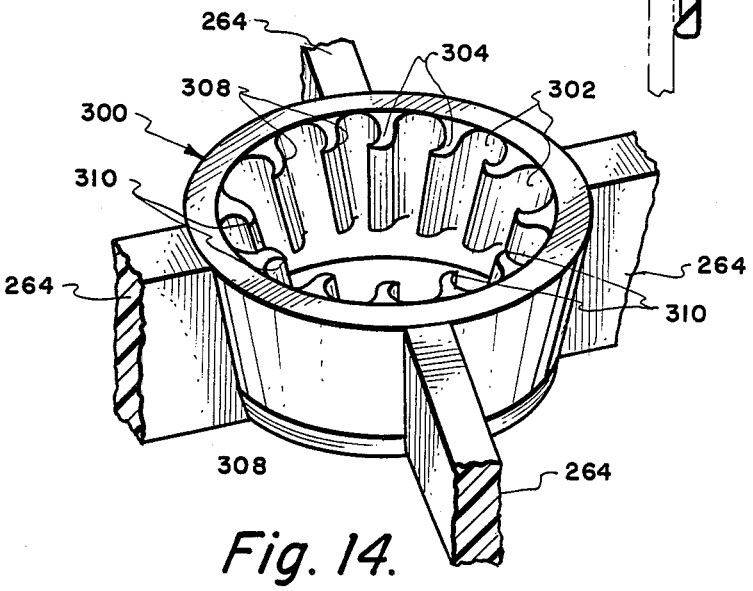
FIG. 14 is an isometric view, partially broken away, depicting the thrust modifier frame of FIG. 12.

The pivot pin 240 extends into the central area 252 of thrust modifier frame 134, best depicted in FIGS. 1, 4, and 11. The thrust modifier frame 134 comprises part of the aforementioned front grill 114 which additionally includes radially extending arms 264. The arms 264 terminate at their free ends in perpendicularly extending portions 266 and 268. As is best depicted in FIG. 4, when the grill 114 is installed within the housing frame 112, arm portion 266 bears against the front surface of frame section 146 while portion 268 bears against the inner surface of housing wall 140. By proper choice of materials and close dimensioning, the grill 114 will be held in place and yet can be readily manually inserted into and removed from the housing 110 to provide access to the interior of the housing.

With the front grill 114 mounted on the housing 110 as depicted in FIG. 4, the thrust modifier frame 134 will be substantially axially aligned with the axis of jet nozzle 170.

The thrust modifier frame 134 comprises a ring 260 having an inner surface including a plurality of symmetrically shaped radially inwardly extending spaced projections 268 defining U-shaped recesses 270 opening toward the center of the ring 260. Each of the recesses 270 is dimensioned so as to readily axially accommodate the pivot pin 240. With the pivot pin 240 accommodated in a frame recess 270, the pin 240 will extend along a line deviating by an acute angle, e.g. 13°, (FIG. 7) from an extension of the jet nozzle 170 axis.

In the operation of the apparatus 100 as thus far described, consider now that pressurized water is supplied from pump 168 via pipe 162 to the nozzle 170. The nozzle 170 will discharge a water jet into a suction cavity 276 (FIG. 4) essentially defined by pipe section wall 158, rear ring 228, and tapered supply orifice 188 to the supply section 186. The water jet discharged at high velocity into this suction cavity 276 creates a suction which acts to draw air, via air pipe 164, into the cavity 276 for entrainment by the water jet. The resulting water-air stream then flows through conduit 116 thrusting the ball surface 198 forwardly against the O-ring 224. The stream will then be discharged through discharge orifice 118 below the upper surface 126 of water pool 128 in a direction having a primary component extending substantially along the conduit elongation for massaging user 109 and a secondary component substantially perpendicular thereto for producing a reaction force which acts on the free discharge end of the conduit 116 to produce both rotational and translational thrust. More specifically, primarily as a consequence of the deviation of the intermediate section 194 axis from the supply section 186 axis, a translational thrust will be produced acting to swivel the ball 199 and translate the discharge end of conduit 116, i.e. orifice 118. Translation of the discharge orifice 118 of course also translates the pivot pin 240 enabling it to move randomly within the confines of thrust modifier frame 134. In addition to the translational thrust produced on the discharge end of the conduit 116, the conduit discharge end is also rotated around the axis defined by nozzle 170, primarily attributable to the deviation between the axis of the conduit discharge section 190 and the plane defined by the axes of conduit sections 186 and 194. The drag plates 244–250 prevent the conduit from rotating too fast.

As a consequence of these reaction forces acting on the discharge end of the conduit 116, the pivot pin 240 will move across the open area 252 defined by thrust modifier ring 260, traversing from one recess 270 to another in a seemingly random unpredictable pattern. That is, after the pin 240 translates across the open area defined by ring 260, it will enter a recess 270 and engage the ring 260 so that the rotational thrust on the conduit discharge end will rotate the discharge end around the pin 240 through a substantially semicircular arc until the discharge orifice 118 moves to an orientation enabling the translational thrust to cause the pin 240 to escape from its recess. The pin will then translate across the ring open area 252 to an opposite recess. Thus, the path described by the discharge orifice 118 will essentially be comprised of a series of semicircular path segments linked by translational path segments. As a consequence of considerable experimentation, using embodiments of the thrust modifier ring similar to that depicted in FIGS. 1, 4 and 11, it has been found that the precise path described by pin 240 and discharge orifice 118 cannot be accurately predicted. More specifically, in actual development embodiments, the pin 240 was found to move essentially randomly from one recess to another, sometimes skipping only one or two recesses and sometimes skipping a much larger number of recesses. In all instances, however, the discharge orifice path was comprised of essentially semicircular path segments linked by translational path segments. The inherent randomness or unpredictability of the discharge orifice path using the thrust modifier frame of FIGS. 1, 4, and 11, has been found to produce an interesting and pleasing massaging effect upon the user. It is not entirely clear, however, whether users prefer such unpredictable randomness or a similar but more predictable discharge orifice path which can be achieved by certain structural modifications as are depicted in applicants, second embodiment shown in FIGS. 12–15.

Attention is now directed to FIGS. 12–15 which depict an embodiment which differs from the previously discussed embodiment only in the structural configuration of the thrust modifier ring portion of the front grill. That is, whereas the ring 260 of FIG. 11 included symetrically shaped radially inwardly extending spaced projections 268 defining U-shaped recesses 270 opening toward the center of the ring 260, the thrust modifier ring 300 on front grill 301 of FIGS. 12–15 includes recesses 302 which open both toward the center of the ring and toward an adjacent recess. More specifically, with particular reference to FIGS. 12 and 14, note that a plurality of spaced identical projections 304 are formed on the inner circumferential surface of ring 300. A recess 302 is formed between each adjacent pair of projections 304.

Each projection 304 defines a smoothly curved edge 308 which comprises the exit or right side edge of a recess 302 along which the pivot pin 240 tends to travel in escaping from a recess. Each projection further includes a hook portion 310 which lies over the left side edge of a recess 302. The particular geometry of the thrust modifier ring 300 depicted in FIGS. 12–15 tends to cause the pivot pin 240 to precess along a path in which it enters each of the recesses 302 and while in each recess rotates through a substantially full 360° circle prior to exiting for the immediately adjacent recess in a counter clockwise direction around ring 30.

In order to better understand the operation of the embodiment of FIGS. 12–15, attention is directed to FIG. 15 which in five successive snap shot views shows how the pivot pin 240 escapes from a recess 302 and translates to the next recess moving around ring 300 in a counter clockwise direction while rotating in a clockwise direction. To lend clarity to the movement of the pin 240 and the path of movement of the discharge orifice 118, a force arrow 320 is depicted in FIG. 15 showing the primary direction of the translational thrust on the conduit discharge end for the various orientations of the conduit. That is, as has been previously mentioned, the translational thrust is primarily attributable to the deviation between the axes of the conduit supply and intermediate sections and acts in a radial direction substantially along drag plate 250. The various orientational views of FIG. 15 also show force arrows 322 and 324 which depict the rotational thrust tending to rotate the conduit in a clockwise direction around the axis of nozzle 170. Although the rotational thrust is actually produced as a reaction to the stream discharged from orifice 118, for simplicity in FIG. 15 it is shown as acting on drag plates 244 and 248.

Figure 15A:
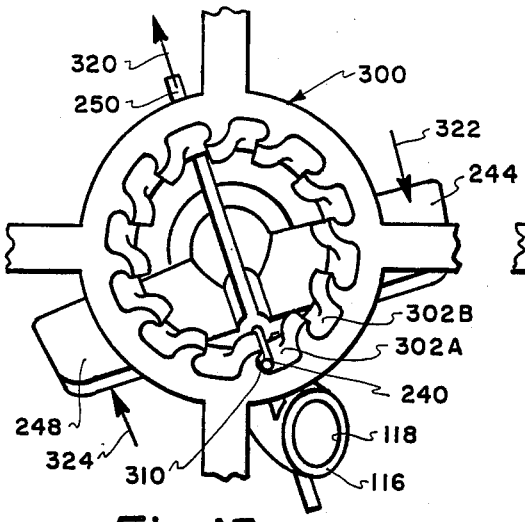
FIGS. 15*a* through 15*e* are schematic frontal views of the embodiment of FIG. 12 showing the motion of the conduit subassembly discharge orifice.
Figure 15B:
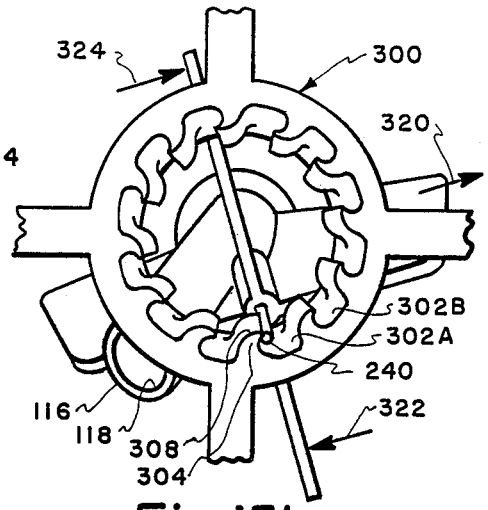
Figure 15C:
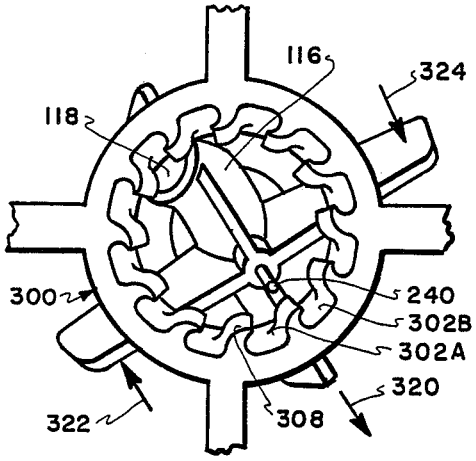
Figure 15D:
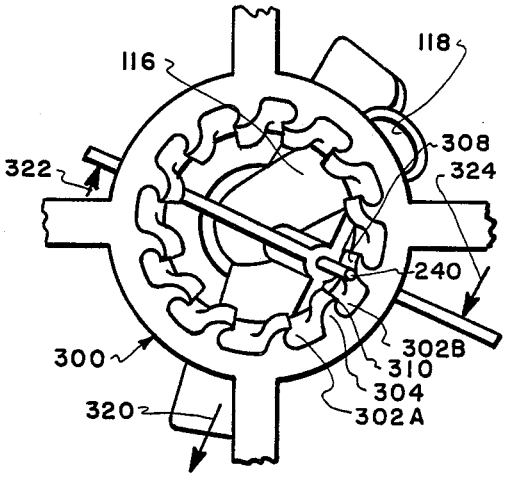
Figure 15E:
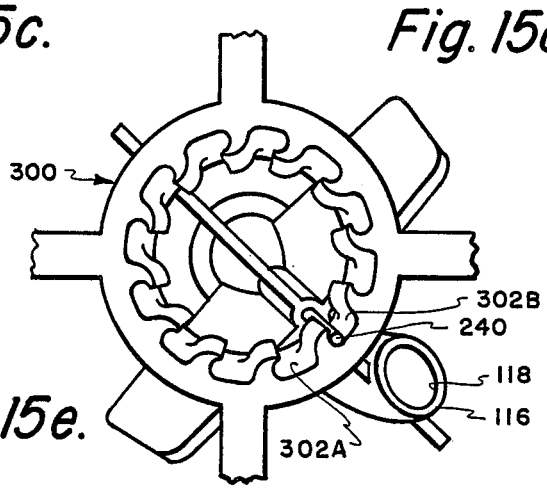

With the foregoing considerations in mind, now consider the orientation of the conduit 116 in FIG. 15*a* wherein the discharge orifice is located at approximately a five o'clock position. With the translational force acting in the direction of arrow 320, the pin 240 will be retained in recess 302A by engaging the overlying hook 310. The rotational force represented by arrows 322 and 324 will rotate the conduit 116 to move the discharge orifice 118 in a clockwise direction toward the seven o'clock orientation depicted in FIG. 15*b*. Note that when in the orientation of FIG. 15*b*, translational force arrow 320 is now acting in a direction tending to move pin 240 out of the recess 302A essentially along exit edge 308 of the projection 304. The rotational force arrows 322 and 324 continue to act to rotate the conduit 116 clockwise. The forces depicted in FIG. 15*b* will move the discharge orifice 118 to the ten o'clock position depicted in FIG. 15*c* which shows the pin 240 having escaped from the recess 302A. When in this position however note that the translational force arrow 320 is acting in a direction tending to move the pin to the immediately adjacent recess 302B in a counterclockwise direction around ring 300. The rotational thrust will continue to rotate the conduit clockwise moving the discharge orifice to the one o'clock position depicted in FIG. 15*d* whereat the pin 240 begins to enter the recess 302B. The translational and rotational forces then move the pin fully into the recess 302B below the hook portion 310 of the projection 304. Thus the view in FIG. 15*e* is substantially identical to that in FIG. 15*a* except that the pivot pin 240 has advanced in a counterclockwise direction along ring 300 from recess 302A to recess 302B. In the course of advancing one recess, the discharge orifice 118 has described a circular path segment. Thus, as the pivot pin 240 precesses around the thrust modifier ring 300 in a counterclockwise direction, the discharge orifice 118 will describe a path comprised of circular path segments linked by short translational path segments from recess to recess.

Although the aforedescribed first and second embodiments operate rather well under most circumstances, it has been observed that the movement of the discharge orifice 118 can become rather sluggish or even stop when the user leans back tightly against the front grill 114, 301. This is believed to be because the user's body effectively blocks the free flow of the discharge stream from the orifice 118 thus creating turbulence around, and back pressure within, the conduit 116 thereby reducing the energy available to move the conduit discharge section. The front grill embodiment of FIGS. 16–18 has been designed to avoid this potential problem.

Figure 16:
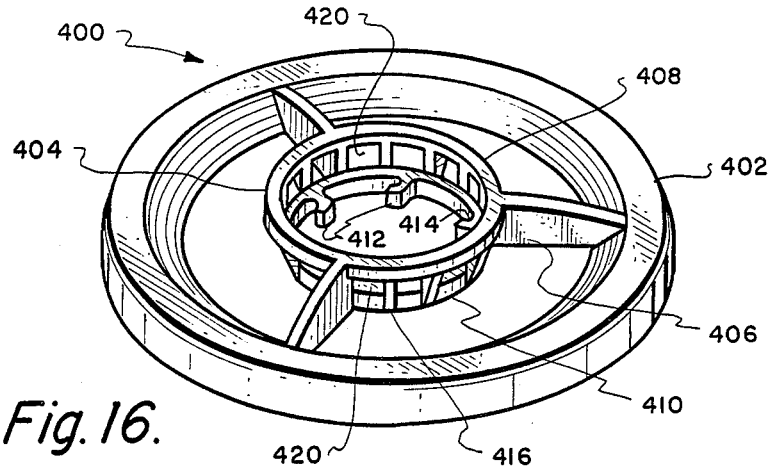
FIG. 16 is an isometric view of a front grill depicting a further alternative thrust modifier frame in accordance with the present invention.
Figure 17:
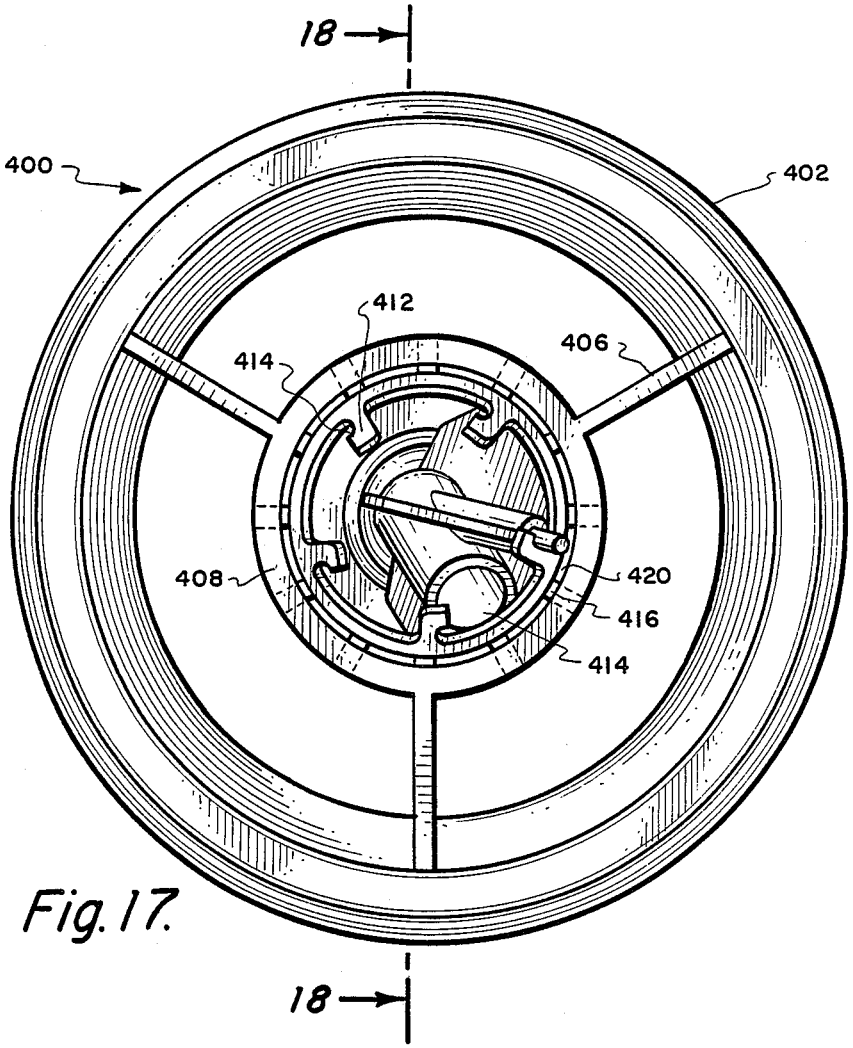
FIG. 17 is a front plan view of the thrust modifier frame of FIG. 16 mounted in front of the conduit discharge orifice.
Figure 18:
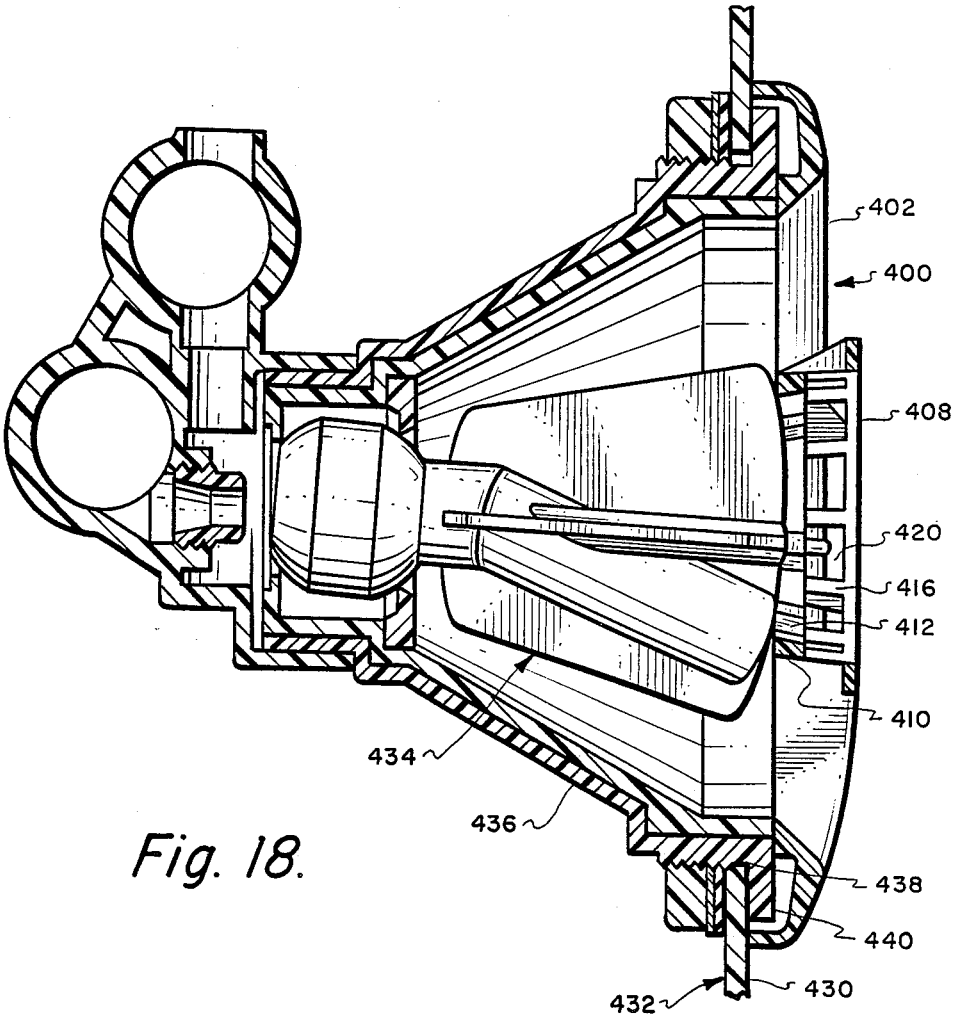
FIG. 18 is a side sectional view taken substantially along the plane 18—18 of FIG. 17.

More specifically, the front grill 400 of FIGS. 16–18 is comprised of an outer frame or ring 402 and a concentric inner frame or ring 404 spaced by radially extending arms 406. The inner ring 404 is configured to include axially spaced forward and rearward ring portions 08, 410 with the rearward portion 410 supporting inwardly extending projections 412 which are used to modify the thrust on the conduit discharge section, as previously discussed. The projections 412 are shaped to define undercut recesses and are substantially identical to projections 304 and recesses 302 of the embodiment of FIGS. 12–15 and function in a substantially identical manner. The particular number of projections used on the thrust modifier ring is an arbitrary design parameter and it is noted that the ring 410 is depicted in FIGS. 16–18 as having fewer projections 412 than the ring 300 of FIGS. 12–15. The use of fewer projections 412 will, of course, have the effect of slightly lengthening the translational path segments linking the circular path segments described by the discharge orifice of FIGS. 16–18 as compared with the path described in FIGS. 12–15.

The forward portion 408 of inner ring 404 is axially spaced from the rearward portion 410 by a plurality of substantially parallel short ribs 416 which are spaced from one another around the circumference of the ring portions. Three of the ribs 416 are respectively defined by the radially inward edges of arms 406. The spacing between adjacent ribs 416 defines openings 420 which enable components of the discharge stream to flow radially in the event a user seals his body against the ring portion 408. By allowing the stream to escape in this manner, turbulence and back pressure buildup in and around the conduit, with attendant dimished discharge orifice motion, can be avoided. In order to even further avoid such diminished discharge orifice motion, note in FIG. 18 that the forward ring portion 408 extends axially forward of the outer ring 402 to thereby essentially prevent the user from sealing his body against the entire outer ring 402.

In use, the front grill 400 is mounted adjacent the inner surface 430 of tub wall 432 in front of the conduit subassembly 434, as depicted in FIG. 18. The conduit subassembly 434 is mounted within housing 436 which projects rearwardly through wall opening 438. Although various techniques could be employed for physically mounting the grill 400 in front of wall opening 438, it is preferred that the grill 400 be mounted to housing flange 440 by a bayonet-type coupling (not shown).

Figure 3:
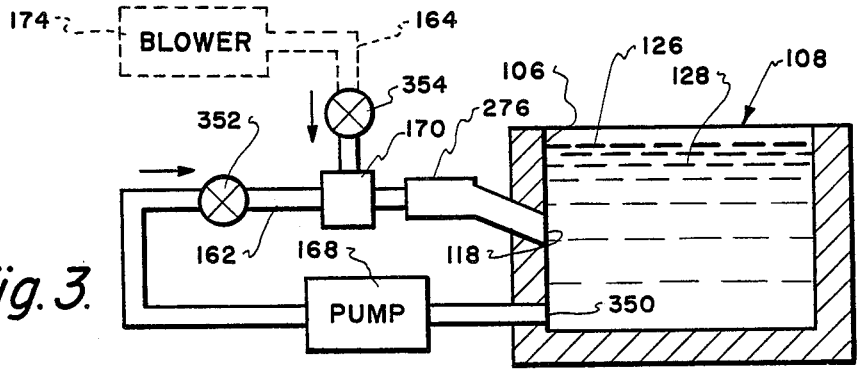
FIG. 3 is a schematic illustration depicting the manner in which an apparatus in accordance with the invention is plumbed in a typical installation.

FIG. 3 schematically depicts a typical plumbing installation for embodiments of the present invention and includes an electric motor driven pump 168 which pulls water from tub 108 via port 350. The pump 168 then supplies a water stream through a manually variable valve 352 to the nozzle 170 discharging into suction cavity 276. Air is preferably supplied to the cavity 276 via the air pipe 164 and a manually variable valve 354. The inlet side of valve 354 can be open to the ambient air or can be coupled to the outlet of an optional motor driven blower 174.

It has been observed that when the air supply to the suction cavity 276 is cut off, either intentionally or inadvertently, the suction created by the water jet discharged from nozzle 170 acts on the conduit itself which in some configurations increases friction loss and results in sluggish swivel movement.

In order to avoid this friction build up and resulting sluggishness, embodiments in accordance with the present invention contemplate that the O-rings 224 and 230 be spaced sufficiently so that the ball 199 can exhibit limited axial movement in the socket 232. More specifically, note in FIG. 4 and in FIG. 13, that the ball 199 is thrust against the forward O-ring 224 as a consequence of the water-air stream entering the supply orifice 188. If the air supply through air pipe 164 is cut off, the resulting suction produced in cavity 276 will pull the ball 199 to the rearward position against O-ring 230 as depicted in FIG. 6. When the ball 199 is pulled rearwardly, it opens a passageway from the water pool 128 to the suction cavity 276 via opening 220 around the surface 198 of ball 199 and through slots 360 in rear ring 228. As a consequence, the suction created by the jet discharged from nozzle 170 will pull pool water into the suction cavity 276 and thereby relieve the rearward suction against the conduit itself and the resulting friction buildup. Instead, the suction will entrain the pool water sucked into the cavity 276 and discharge a water stream of lower velocity but greater mass as compared to a stream with entrained air.

From the foregoing, it should now be recognized that hydrotherapy embodiments have been disclosed herein for impacting against a user while concurrently causing the discharge orifice to move along a path defining a planar area oriented substantially perpendicular to the direction of stream discharge. The travel path is characterized by a series of small circular or semicircular path segments linked by translational path segments and the discharge orifice is moved along the path by reaction forces produced by the discharged stream.

We claim:

1. Hydrotherapy apparatus for discharging a fluid stream useful for impacting against and massaging an area of a user's body, said apparatus comprising:

supply means including a cavity and means for discharging a water jet along a defined axis into said cavity for creating a suction therein;

an elongated rigid conduit including a tubular supply section having a supply orifice and a tubular discharge section having a discharge orifice;

means mounting said conduit with said supply orifice opening to said cavity whereby water supplied from said jet will flow through said conduit to said discharge orifice;

said discharge orifice being oriented to discharge a water stream having a primary massage component extending substantially in the direction of said conduit elongation and a secondary thrust component extending substantially perpendicular to said conduit elongation;

said mounting means including swivel means supporting said conduit supply section for rotation about the axis of said supply section and about vertical and horizontal axes oriented perpendicular to said supply section axis whereby said discharge orifice can translate along a random path describing a substantially planar area; and passageway means for drawing water from outside said conduit into said cavity to mitigate the effect of said suction on said conduit.

2. The apparatus of claim 1 wherein said supply means further includes means for supplying air to said cavity.

3. The apparatus of claim 1 wherein said conduit further includes a tubular intermediate section coupling said supply section to said discharge section; and wherein the axis of said intermediate section deviates by an acute angle from the axis of said supply section.

4. The apparatus of claim 3 wherein the axis of said discharge section deviates by an acute angle from the plane defined by the axes of said supply and intermediate sections whereby said water stream secondary thrust component produces a force on said discharge section acting to translate said discharge orifice across said area and rotate said conduit supply section around its axis.

5. The apparatus of claim 4 wherein said swivel means defines a center of rotation; and wherein the projection of said intermediate section axis is displaced from said center of rotation.

6. The apparatus of claim 1 in combination with a water tub having a peripheral wall;

means mounting said apparatus in a first opening in said peripheral wall with said conduit oriented so that water discharged through said discharge orifice flows into said tub.

7. The apparatus of claim 6 including a second opening in said peripheral wall;

pump means having a suction side and a pressure side; and means coupling said pump means suction side to said second opening and said pressure side to said means for discharging said water jet into said cavity.

8. The apparatus of claim 1 wherein said conduit is mounted for reciprocal movement substantially along said conduit supply section axis between forward and rearward positions; and including means for sealing said passageway means when said conduit is in said forward position and opening said passageway means when said conduit is in said rearward position.

9. The apparatus of claim 1 including thrust modifier means for reorienting said conduit to redirect said thrust component in response to said discharge orifice approaching a boundary of said area.

10. The apparatus of claim 9 wherein said thrust modifier means includes:

a pin extending from said conduit substantially along a projection of said supply section axis so as to be laterally displaced from said discharge section; and means associated with said area boundary for pivoting said discharge orifice around said pin.

11. The apparatus of claim 10 wherein said thrust modifier means further includes:

a frame defining a plurality of open recesses for temporarily receiving said pin to cause said thrust component to pivot said discharge orifice around said pin and redirect the movement of said discharge orifice across said area.

12. The apparatus of claim 11 wherein said frame is circular and wherein said recesses open toward the center of said circular frame.

13. The apparatus of claim 11 wherein said frame is circular and wherein each of said recesses opens toward the center of said frame and toward an adjacent recess.

14. Hydrotherapy apparatus for discharging a fluid stream useful for impacting against and massaging an area of a user's body, said apparatus comprising:

supply means including a cavity and means for discharging a water jet along a defined axis into said cavity for creating a suction therein;

an elongated rigid conduit including a tubular supply section having a supply orifice and a tubular discharge section having a discharge orifice;

means mounting said conduit with said supply orifice opening to said cavity whereby water supplied from said jet will flow through said conduit to said discharge orifice, said mounting means including swivel means supporting said conduit supply section for rotation about the axis of said supply section and about vertical and horizontal axes oriented perpendicular to said supply section axis whereby said discharge orifice can translate along a random path describing a substantially planar area;

said discharge orifice being oriented to discharge a water stream having a primary massage component extending substantially in the direction of said conduit elongation for impacting against said user's body and a secondary thrust component extending substantially perpendicular to said conduit elongation for producing a force on said discharge section acting to translate said discharge orifice across said area and rotate said conduit supply section around its axis; and;

thrust modifier means for reorienting said conduit to redirect said thrust component in response to said discharge orifice approaching a boundary of said area, said thrust modifier means including:

a pin extending from said conduit substantially along a projection of said supply section axis so as to be laterally displaced from said discharge section;

a frame having a series of recesses formed therealong, each recess opening toward the center of said frame and an adjacent recess; and means mounting said frame substantially contiguous with said planar area whereby when said pin moves into a recess to engage said frame, said thrust component will pivot said discharge orifice around said pin to redirect the movement of said pin toward said adjacent recess.

15. The apparatus of claim 14 in combination with a water tub having a peripheral wall;

means mounting said apparatus in a first opening in said peripheral wall with said conduit oriented so that water discharged through said discharge orifice flows into said tub.

16. The apparatus of claim 15 including a second opening in said peripheral wall;

pump means having a suction side and a pressure side; and means coupling said pump means suction side to said second opening and said pressure side to said means for discharging said water jet into said cavity.

17. The apparatus of claim 14 further including passageway means for drawing water from outside said conduit into said cavity to mitigate the effect of said suction on said conduit.

18. The apparatus of claim 14 wherein said conduit further includes a tubular intermediate section coupling said supply section to said discharge section; and wherein the axis of said intermediate section deviates by an acute angle from the axis of said supply section.

19. The apparatus of claim 18 wherein the axis of said discharge section deviates by an acute angle from the plane defined by the axes of said supply and intermediate sections.

20. The apparatus of claim 14 wherein said supply means further includes means for supplying air to said cavity.

21. Hydrotherapy apparatus for discharging a water stream beneath the surface of a water pool while concurrently translating the stream along a path describing an area, said apparatus including:

an elongated rigid conduit having a tubular supply section defining a supply orifice, a tubular discharge section defining a discharge orifice, and a tubular intermediate section coupling said supply section to said discharge section;

said intermediate section having an axis deviating by an acute angle from the axis of said supply section;

said discharge section having an axis deviating by an acute angle from the plane defined by the axes of said supply and intermediate sections;

mounting means formed on said conduit defining a center of rotation proximate to said supply orifice for swivelling said conduit about said center of rotation; and wherein the projection of said intermediate section axis is displaced from said center of rotation.

22. The apparatus of claim 21 further including at least one drag plate extending substantially from said supply section axis.

23. The apparatus of claim 21 wherein said mounting means includes an exterior spherical surface formed on said supply section.

24. The apparatus of claim 21 further including a pin extending from said conduit substantially along a projection of said supply section axis so as to be spaced from said discharge section.

25. A method of massaging a user's body in a water tub having a peripheral wall, said method comprising the steps of:

supplying a water stream;

discharging said water stream into said tub through an opening in an area of said wall such that said discharged stream has a primary component extending substantially perpendicular to said wall area for impacting against said user's body and a secondary component extending substantially parallel to said wall area for producing a thrust in a direction substantially parallel to said wall area; and sequentially directing said secondary component in different directions to move said stream along a path extending substantially parallel to said wall area and comprised of a series of small circles successively spaced from one another.

26. The apparatus of claim 10 including a front grill mounted substantially parallel to said planar area; and wherein said means for pivoting said discharge orifice around said pin includes an open central frame formed in said grill, said central frame defining a plurality of open recesses for temporarily receiving said pin to cause said thrust component to pivot said discharge orifice around said pin and redirect the movement of said discharge orifice across said area.

27. The apparatus of claim 26 wherein said central frame includes a plurality of openings extending radially therethrough.

28. The apparatus of claim 10 including a substantially planar front grill comprising an outer frame and an inner frame;

means mounting said front grill substantially perpendicular to said defined axis forward of said conduit discharge orifice; and wherein said means for pivoting said discharge orifice around said pin comprises a plurality of open recesses spaced along the periphery of said inner frame for temporarily receiving said pin to cause said thrust component to pivot said discharge orifice around said pin and redirect the movement of said discharge orifice across said area.

29. The apparatus of claim 28 wherein said frame includes a plurality of openings extending radially therethrough.

30. The apparatus of claim 28 wherein said inner frame extends axially forward of said outer frame.

31. The apparatus of claim 14 wherein said frame includes a plurality of openings extending radially therethrough.

32. The apparatus of claim 14 wherein said means mounting said frame comprises a substantially planar front grill including an outer peripheral member surrounding said frame and structurally attached thereto, said frame projecting forwardly of said peripheral member to prevent said user's body from sealing against said peripheral member.

33. The apparatus of claim 32 wherein said frame includes a plurality of openings extending radially therethrough.

* * * * *